US009415618B2

(12) United States Patent
Cao et al.

(10) Patent No.: US 9,415,618 B2
(45) Date of Patent: Aug. 16, 2016

(54) RIBBON CASSETTE FOR LABEL PRINTING DEVICE

(71) Applicant: ZHUHAI NINESTAR MANAGEMENT CO., LTD., Zhuhai (CN)

(72) Inventors: Jianxin Cao, Zhuhai (CN); Shengyu Wei, Zhuhai (CN)

(73) Assignee: ZHUHAI NINESTAR MANAGEMENT CO., LTD., Guangdong (CN)

( * ) Notice: Subject to any disclaimer, the term of this patent is extended or adjusted under 35 U.S.C. 154(b) by 0 days.

(21) Appl. No.: 14/831,822

(22) Filed: Aug. 20, 2015

(65) Prior Publication Data

US 2015/0360493 A1 Dec. 17, 2015

Related U.S. Application Data

(63) Continuation of application No. PCT/CN2014/081947, filed on Jul. 10, 2014.

(30) Foreign Application Priority Data

Sep. 2, 2013 (CN) ..... 2013 1 0393488

(51) Int. Cl.
*B41J 32/00* (2006.01)
*B41J 35/36* (2006.01)
(Continued)

(52) U.S. Cl.
CPC ..... *B41J 32/00* (2013.01); *B41J 3/4075* (2013.01); *B41J 15/044* (2013.01); *B41J 35/36* (2013.01)

(58) Field of Classification Search
CPC ..... B41J 3/4075; B41J 15/044; B41J 32/00; B41J 35/36
See application file for complete search history.

(56) References Cited

U.S. PATENT DOCUMENTS 5,727,888 A * 3/1998 Sugimoto ..... B41J 2/325 400/247
2005/0200650 A1 9/2005 Inokuchi et al. ..... 347/37

FOREIGN PATENT DOCUMENTS

CN 1865012 A 11/2006
CN 100429081 C 10/2008
CN 101758672 A 6/2010
(Continued)

OTHER PUBLICATIONS

International Search Report of corresponding International PCT Application No. PCT/CN2014/081947, dated Oct. 29, 2014.
(Continued)

*Primary Examiner* — Manish S Shah
*Assistant Examiner* — Roger W Pisha, II
(74) *Attorney, Agent, or Firm* — J.C. Patents

(57) ABSTRACT

Disclosed is a ribbon cassette for a label printing device, comprising a ribbon cassette case that contains a printing tape (18), a medium tape (17), and a carrier tape (20). The label printing device is provided with a determining region (5) for determining feature information of the ribbon cassette, the determining region is provided with a plurality of determining columns (XY) with planar distribution. The ribbon cassette further comprises a detecting portion (10) corresponding to the determining region, the detecting portion is detecting column(s) (11) corresponding to the determining columns. The number, position, or a combination of the number and the position of the detecting column characterizes the feature of the ribbon cassette.

10 Claims, 18 Drawing Sheets

(51) Int. Cl.
*B41J 3/407* (2006.01)
*B41J 15/04* (2006.01)

(56) References Cited

FOREIGN PATENT DOCUMENTS

| | | | |
|---|---|---|---|
| CN | 101850672 | A | 10/2010 |
| CN | 102481794 | A | 5/2012 |
| CN | 102574401 | A | 7/2012 |
| CN | 102837511 | A | 12/2012 |
| CN | 102858551 | A | 1/2013 |
| CN | 203004553 | U | 6/2013 |
| CN | 203004554 | U | 6/2013 |
| CN | 203472297 | U | 3/2014 |
| EP | 0 734 872 | A2 | 10/1996 |
| EP | 1 084 852 | A1 | 3/2001 |
| EP | 1 424 209 | A1 | 6/2001 |
| EP | 1 700 705 | A1 | 9/2006 |
| EP | 1 955 856 | A2 | 8/2008 |

OTHER PUBLICATIONS

The Chinese First Examination Report of corresponding China patent application No. 201310393488.4 dated Mar. 24, 2016.

* cited by examiner

RIBBON CASSETTE FOR LABEL PRINTING DEVICE

CROSS-REFERENCE TO RELATED APPLICATIONS

This application is a continuation of International Application No. PCT/CN2014/081947, filed on Jul. 10, 2014, which claims the priority benefit of Chinese Patent Application No. 201310393488.4, filed on Sep. 2, 2013. The contents of the above identified applications are incorporated herein by reference in their entireties.

FIELD OF THE INVENTION

The present invention relates to a ribbon cassette for label printing device.

BACKGROUND OF THE INVENTION

In the prior art, such type of ribbon cassette is available, which includes a ribbon cassette case, the ribbon cassette case accommodates a printing tape for printing, a medium tape for providing printing medium and a carrier tape used as a carrier. The printing tape is discharged from a discharging port along a feeding path, and a printing part is disposed at the upstream of the discharging port is provided. The printing tape and the medium tape converge at the printing part, and printing information on the printing medium is thermally transferred onto the printing tape by a thermal transfer head of a printing device. Next, the printing tape and the carrier tape are adhered around the discharging port, and meanwhile are discharged from the ribbon cassette case. Then, the adhered printing tape and carrier tape are cut off at the position of cutting knife of label printing device to generate a label desired by a user.

However, for different applications, printing tapes with different widths are needed and, meanwhile the information corresponding to the printing tapes with different widths are stored in the printing device, and only when the information detected by the printing device is matched with the actual information of the ribbon cassette, will the printing device perform printing task, otherwise a printing error message will be prompted. The prior art, for example Chinese patent No. CN102481794A, discloses a strippable marking part which can be detachably installed on a ribbon cassette and information of different printing tape width is reflected by different strippable parts. This method can determine feature information of the ribbon cassette. However, it requires different marking parts for the information of different printing tape width. Therefore, the number of molds being used is increased and, thus, the total cost of the product is increased.

As disclosed in Chinese patent No. CN101850672A, a first indicator portion and a second indicator portion are used to determine the feature information of a ribbon cassette, and a combination of pore and non-pore portions provided by the first and second indicator portions reflects different feature information of the ribbon cassette. However, since the ribbon cassette is small as a whole, and the porous and non-porous parts matched with the printing device occupy the smaller space, in the case that the adjacent positions have pores, then the distance between centers of two pores is only slightly greater than the diameter of the pores, so that the diameter of the pores is only slightly greater than that of a determining column of the printing device. In the process of using the ribbon cassette, i.e., in the process of installing the ribbon cassette into the printing device, if there is a slight misplacement, it is highly possible that the printing device's determining column either cannot accurately enter the pore or cannot accurately contact the non-pore portion, which will lead that the printing device cannot accurately detect the feature information of the ribbon cassette, that is, printing task cannot be executed.

As disclosed in Chinese patent No. CN100429081C, a switching device used for determining width of a narrow tape part is to determine feature information of ribbon cassette by determining whether there is a gap at the upper and lower shells corresponding to the position of the printing device's determining column. This can avoid the problem of incapable of determination due to a slight misplacement during installation of the ribbon cassette and other problems. However, only a few switching devices are provided in the patent CN100429081C, the amount of information detected is thus less. However, with the development of ribbon cassette product, the amount of information included in the ribbon cassette is increasing, such as the width of the printing tape in the ribbon cassette; the width and the color of the medium tape; the width and the color of the carrier tape; the width of the ribbon cassette; and the printing way of printing tape (e.g., mirror printing or non-mirror printing, etc.). It is obvious that it cannot meet the requirement if a small number of the switching devices are adopted. In addition, in the case that a parallel switching device is required (see FIG. 29 for details), the aforementioned technical solution in the patent is difficult to be achieved.

SUMMARY OF THE INVENTION

The present invention provides a ribbon cassette for a label printing device in order to solve the technical problem of inaccurate determination of feature information of a ribbon cassette by a label printing device due to an improperly designed structure of detecting portion of the ribbon cassette used in the existing label printing device.

The following technical solutions are adopted in the present invention to solve the aforementioned technical problem.

A ribbon cassette for a label printing device, which label printing device is provided with a determining region for determining feature information of the ribbon cassette, the determining region is provided with a plurality of determining columns, the ribbon cassette includes a ribbon cassette case that accommodates a printing tape for printing, a medium tape for providing printing medium and a carrier tape used as a carrier, the ribbon cassette further includes a detecting portion corresponding to the determining region of the label printing device, characterized in that, the detecting portion is one or more detecting columns corresponding to the determining columns. The number of the detecting column characterizes the feature of the ribbon cassette, the position of the detecting column characterizes the feature of the ribbon cassette, or a combination of the number and position of the detecting column characterizes the feature of the ribbon cassette.

The detecting column is in a cylindrical shape.

The detecting column is in a columnar shape with an oval cross-section.

The detecting column is in a columnar shape with a square or rectangular cross-section.

The column surface of the detecting column can completely cover the corresponding column surface of the determining column.

The features of the ribbon cassette includes width of the printing tape of the ribbon cassette, width and color of the medium tape, width and color of the carrier tape, width of the ribbon cassette and printing mode of the printing tape.

There is a plurality of the detecting columns, and a reinforcing rib is provided between adjacent detecting columns.

There are a plurality of the detecting columns and a reinforcing rib is provided between adjacent detecting columns.

After adopting the aforementioned technical solutions, since the detecting portion is detecting column corresponding to the determining column, the number, the position or a combination of the number and the position of the detecting column characterizes the feature of the ribbon cassette, and each of the detecting columns corresponds to one determining column. The detecting column is against the corresponding determining column so that label printing device can perform detection, which significantly improves accuracy of detection of the feature information of the ribbon cassette compared with the combination of pore and non-pore portions adopted in the detecting portion. This solves the technical problems of inaccurate determination of feature information of a ribbon cassette by label printing device due to improperly designed structure of detecting portion in the ribbon cassette of the existing label printing device. In addition, because of cooperation between the detecting column with a larger diameter and the determining column with a smaller diameter, or between the concave/convex surfaces of the ribbon cassette and the determining column of the printing device, the phenomena that the determining column cannot be pressed-into or evaded is avoided, and the hidden trouble that cannot be determined when cooperating the pore with the determining column is eliminated.

DETAILED DESCRIPTION OF THE EMBODIMENTS

Hereinafter, two embodiments of the present invention will be described with reference to the drawings.

Embodiment 1

Figure 1:
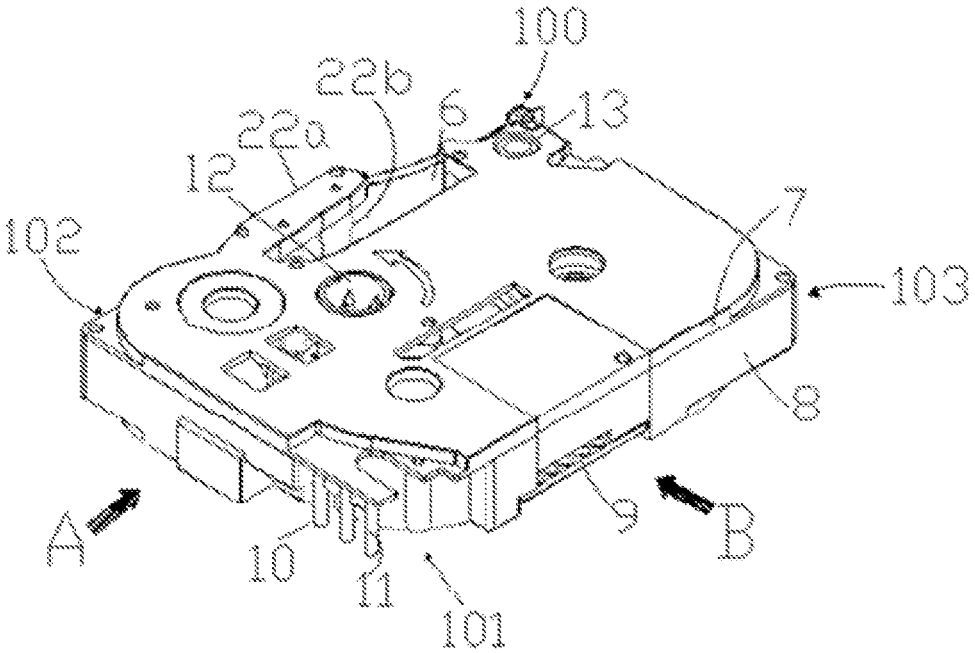
FIG. 1 is a perspective view of an external appearance of a ribbon cassette according to the present invention.
Figure 3:
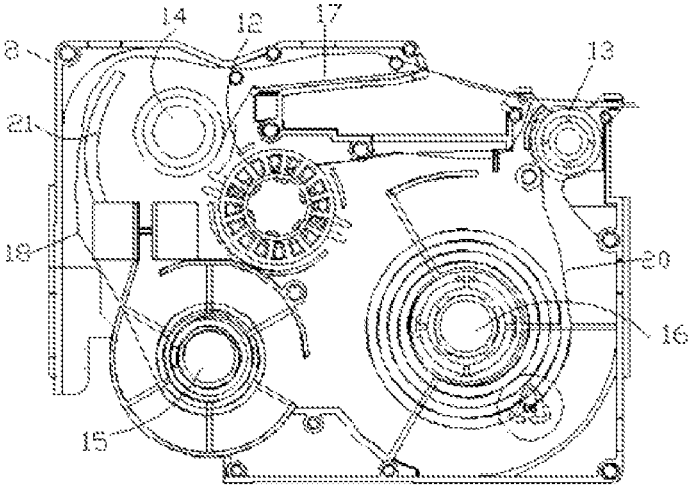
FIG. 3 is a top view of a ribbon cassette with upper cover removed according to the present invention.

FIG. 1 and FIG. 3, according to the present invention, respectively show a perspective view of the outer appearance of a ribbon cassette and a top view of the ribbon cassette with upper cover removed. The ribbon cassette is formed by an upper cover 7 and a lower cover 8, and a ribbon cassette case is formed therebetween. The ribbon cassette case can accommodate a printing tape 18 for printing, a medium tape 17 for providing printing medium and a carrier tape 20 used as a carrier. In general, the ribbon cassette further includes a medium tape driving roller 12, a carrier tape driving roller 13, a medium tape winding roller 14, a printing tape winding tape 15 and a medium tape winding roller 16.

Figure 4:
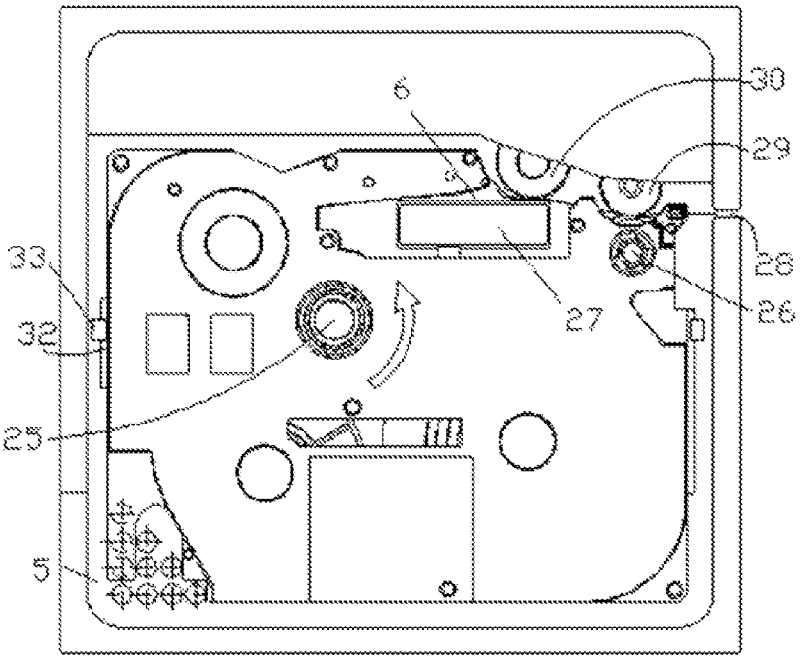
FIG. 4 is a schematic view of a ribbon cassette cooperated with a printing device according to the present invention.

At the edge of one side of the ribbon cassette, there is an opening that is substantially in a rectangular shape and goes through upward and downward. The opening is a printing region 6 accommodating a printing head 27 of a printing device. The printing region 6 is close to one corner of the ribbon cassette, and the corner is called as a first corner 100. A latch reinforcement 32 is provided at the both sides of the ribbon cassette, and matched with a locating part 33 of the printing device, as shown in FIG. 4. It will be described in detail hereinafter.

Figure 2:
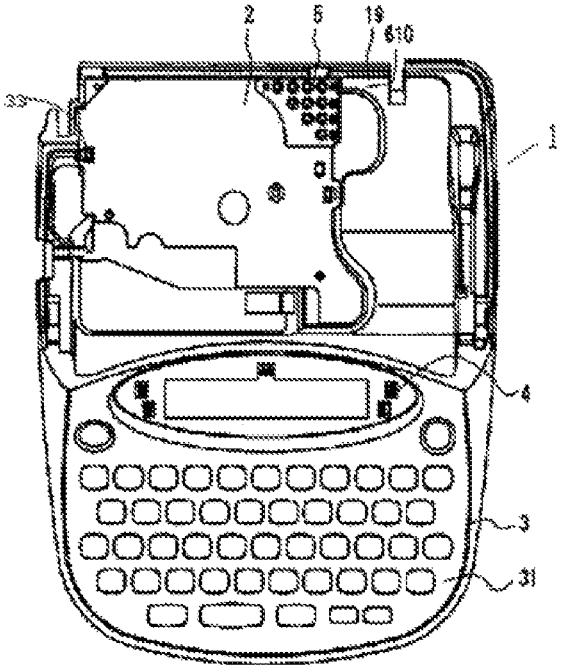
FIG. 2 is a top view of a printing device with top cover opened according to the present invention.

FIG. 2 shows a top view of a printing device 1 with top cover opened. The region indicated by the number 2 refers to a ribbon cassette case for accommodating the ribbon cassette of the printing device. When a ribbon cassette with a defined information of printing tape is installed into the printing device, a detecting column 11 in the region where a detecting portion 10 of the ribbon cassette is located interacts with a determining column XY in the region where determining region 5 of the printing device is disposed, and a user input the required information by a keyboard 31 in a input region 3 of the printing device 1, for example, printing content, or printing format, and the like. Then, the information will be displayed in a display region 4 of the printing device 1, and the user check whether the input is correct according to the displayed content and finally perform a printing task.

FIG. 3 shows a top view of a ribbon cassette with the upper cover removed. One end of the medium tape 17 is wound onto the medium tape winding roller 14, and the other end is wound onto the medium tape driving tape 12. In the case that a medium tape driving shaft 25 is engaged with the medium tape driving roller 12, as shown in FIG. 4, the aforementioned medium tape driving roller 12 will rotate in a anticlockwise direction perpendicular to the paper, and the medium tape 17 is delivered onto the medium tape driving roller 12 by the medium tape winding roller 14 along a feeding path. The printing tape 18 has one end wound onto the printing tape winding roller 15, and has the other end moved from a second corner 101 at which the printing tape winding roller 15 is disposed to the first corner 100 through a third corner 102 of the ribbon cassette along a feeding path, and a guiding board 21 is designed to avoid an interference between the printing tape 18 and the medium tape 17 when passing through the third corner 102. The carrier tape 20 has one end wound onto the carrier tape winding roller 16, and the other end engaged with the printing tape 18 at the first corner 100 in the manner of a stripped layer contacting with the carrier driving roller 13 along a feeding path. Specifically, one side of the carrier tape 20 is adhesive and the other side thereof has a strippable layer. The adhesive side is used for conveniently contacting with the printing tape 18 and further binding both of them; and the side having the strippable layer is used to tear off the strippable layer when a label is formed so that the label is pasted onto an article to be pasted.

Figure 3A:
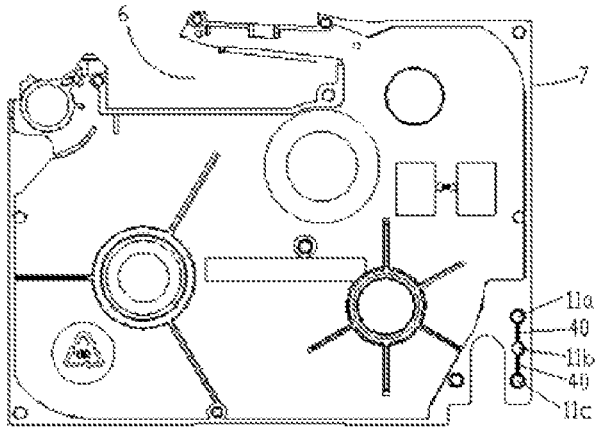
FIG. 3A is a plan view of an upper cover of the ribbon cassette according to the present invention.
Figure 3B:
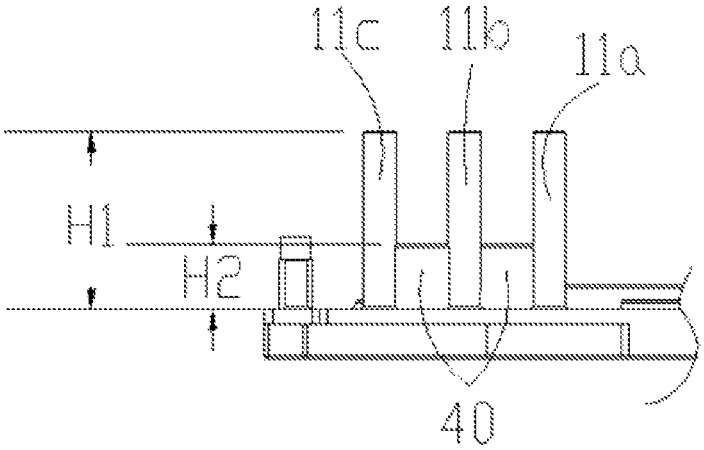
FIG. 3B is a right-side view of FIG. 3A.

FIG. 3A shows a plan view of an upper cover of the ribbon cassette. In this embodiment, the aforementioned detecting portion 10 is designed in the form of the detecting column 11, and the number, position or a combination of the number and the position of the detecting column 11 characterizes the features of the ribbon cassette, and each of the detecting columns corresponds to one detection column. The detecting column 11 can be formed in an upper cover or a lower cover. FIG. 3A shows a structural view of a 9 mm-wide printing tape 18, including detecting columns 11*a*, 11*b* and 11*c*. The detecting column is designed in a cylindrical shape, and of course, others shapes having the same function such as square are also in the protection scope of the present invention. In consideration of the fact that the aforementioned detecting columns 11*a*, 11*b* and 11*c* have a smaller diameter but a greater height, and specifically, the diameter is around 3 mm or greater, and the height H1 is around 7 mm, a reinforcing rib 40 is arranged between adjacent two detecting columns FIG. 3B is a right-side view of FIG. 3A, the reinforcing rib 40 has a height of around 2 mm. Such design not only ensures the strength of the detecting column 11, but also makes the reinforcing rib 40 not interfere with cooperation between the detecting column 11 and determining column XY of the printing device 1.

Figure 4A:
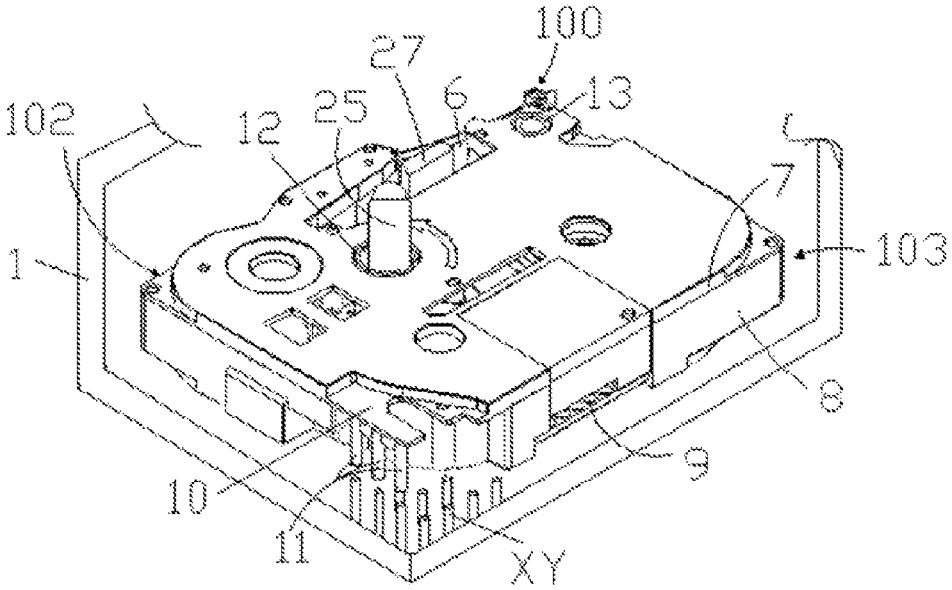
FIG. 4A is a perspective view of the ribbon cassette cooperating with a printing device according to the present invention.

In general, the medium tape 17 is covered with a layer of toner on the surface near one side of the printing tape 18. The toner can be removed from the medium tape 17 by a thermal transfer head 27 of the printing device. As shown in FIG. 4 and FIG. 4A, at the printing region 6, the medium tape 17 and the printing tape 18 are tightly bound with each other via a medium tape compressing roller 30 of the printing device, and the printing contents inputted to the printing device by a user are reflected by the thermal transfer head 27, and the toner is transferred onto the printing tape 18 in the manner of thermal transfer; at the downstream of the printing region 6, the medium tape 17 transferred is wound backward onto the medium tape driving roller 12 along a second path that is different from a feeding path.

Meanwhile, when the carrier tape 20 is fed to the position where the carrier tape driving roller 13 is located along a feeding path, the carrier tape compressing roller 29 of the printing device 1 will press the carrier tape 20 onto the carrier tape driving roller 13 and thus the carrier tape driving roller 13 is engaged with the carrier tape driving shaft 26 of the printing device 1. Under the driving of the carrier tape driving shaft 26, the carrier tape driving roller 13 synchronously rotate in a clockwise direction perpendicular to the paper. The contact surface between the carrier tape 20 and the printed printing tape 18 is adhesive, and when contacting with the printed printing tape 18 at the first corner 100, the carrier tape 20 adheres to it, and then they are discharged together out of the ribbon cassette case and further is cut off at a discharging exit 28 of the printing device by a cutting knife (not shown) to form a user-desired label. The label contains thermal transfer information characters held between the printing tape 18 and the carrier tape 20, so that the label with such a structure has the extraordinary advantages such as anti-abrasion, anti-corrosion, and anti-UV. During the process of printing, the aforementioned medium tape driving shaft 25, the carrier tape driving shaft 26, the carrier tape compressing roller 29 and the medium tape compressing roller 30 synchronously rotate, to ensure synchronous outputs of the medium tape 17, the printing tape 18 and the carrier tape 20, and thus avoid a jam between the tapes.

Figure 5:
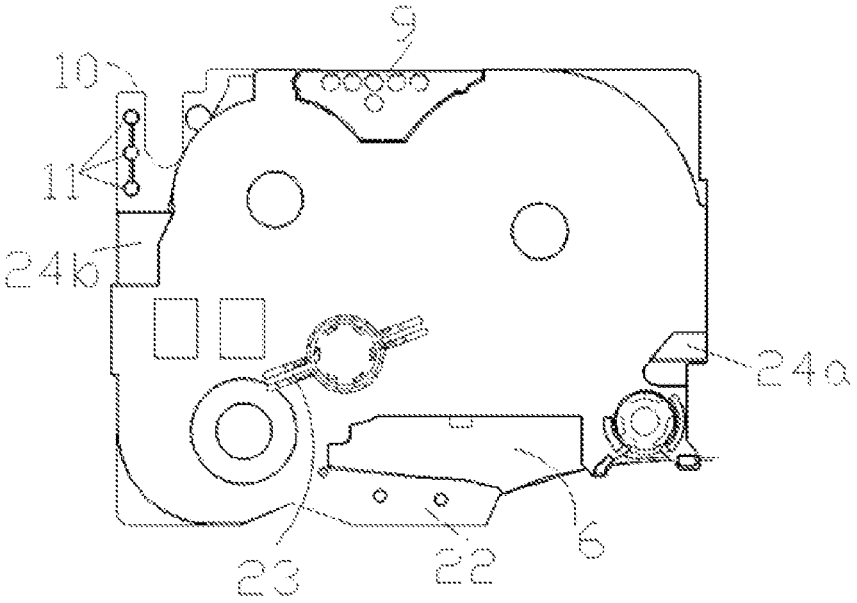
FIG. 5 is a front view of a lower cover of a ribbon cassette according to the present invention.

FIG. 5 shows a front view of a lower cover of the ribbon cassette according to an embodiment. The cassette further includes an information portion 9, which cooperates with an information column (not shown) of the printing device to determine the relevant information of the carrier tape 20. There are positioning grooves 24*a*, 24*b* disposed at the position near both sides of the ribbon cassette for the purpose of circumferential positioning between the ribbon cassette and the printing device. On the lower cover corresponding to the medium tape driving roller 12, an anti-reverse rotating portion 23 is provided, which cooperates with the printing tape driving roller 12 to prevent the printing tape driving roller 12 from rotating in a clockwise direction. The details for this can refer to patent No. CN201220742774.8.

Figure 5A:
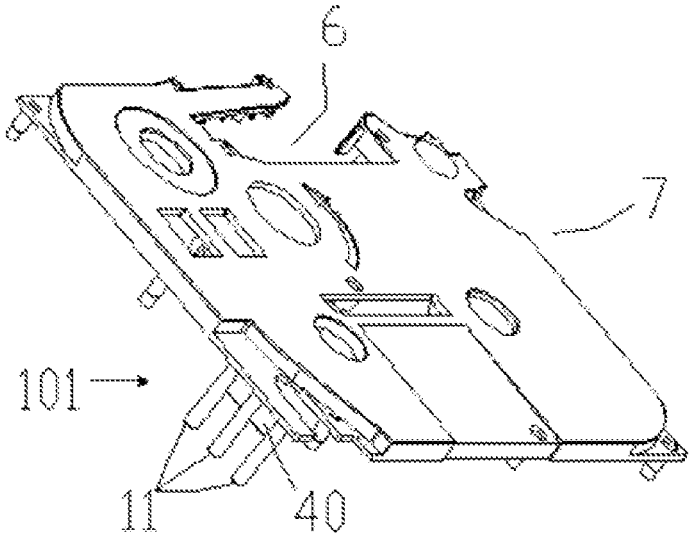
FIG. 5A is a perspective view of an upper cover of the ribbon cassette according to the present invention.

FIG. 5A shows a perspective view of an upper cover of the ribbon cassette according to the embodiment, where the reinforcing rib 40 is designed between the detecting columns 11. The detecting columns 11 are disposed at the second corner 101. In this embodiment, the detecting column 11 is positioned on the upper cover and is formed together with the upper cover by injection molding, and of course, the detecting column 11 also may be designed on the lower cover without influence on its functions in use.

Figure 6:
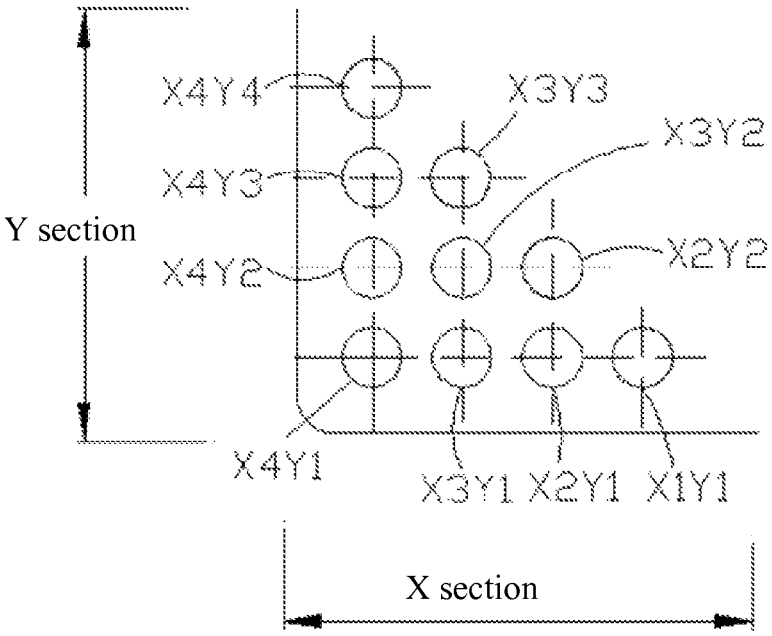
FIG. 6 is a schematic view of the position of the determining column in determining region of a printing device according to the present invention.

FIG. 6 shows a locally enlarged schematic view of the determining region 5 of the printing device 1. In this embodiment, the determining region 5 is marked with X section information portion and Y section information portion, where X section sequentially has positions X1, X2, X3 and X4, and Y section sequentially has positions Y1, Y2, Y3 and Y4, a combination of X and Y represents a position where a determining column is located. This embodiment provides 10 combinations, which indicates 10 determining columns that are in sequence as X1Y1, X2Y1, X3Y1, X4Y1, X2Y2, X3Y2, X4Y2, X3Y3, X4Y3, X4Y4, in which combinations of any two, three or four determining columns can represent different information of the ribbon cassette, including a huge amount of information, and specifically, the combinations may include at least 375 types of information and is sufficient for the ribbon cassette. The aforementioned determining column XY is mobilizable, and specifically, its one end is protruding from the bottom surface of the printing device, and the other end is fixed on the printing device and in a stretchable state. If the determining column XY is not compressed, its one end is above the bottom surface of the printing device, i.e., protruding from the bottom surface of the printing device 1, and at the moment the determining column XY keeps OFF state. When the determining column XY is compressed into the printing device 1, one end of the detection column XY is substantially on the same level as the bottom surface of the printing device, i.e., not protruding from the bottom surface of the printing device, and at the moment the determining column XY keeps ON state. The OFF or ON states of the determining columns in different positions reflect different information of the printing tape.

As shown in Table below, the present embodiment gives specific examples illustrating predetermined information in the printing device.

| | Width of label | | | | | |
|---|---|---|---|---|---|---|
| Combination | 6 mm | 9 mm | 12 mm | 18 mm | 24 mm | 36 mm |
| X1Y1 | OFF | OFF | OFF | OFF | OFF | OFF |
| X2Y1 | OFF | OFF | OFF | OFF | OFF | OFF |
| X3Y1 | OFF | OFF | OFF | OFF | OFF | OFF |
| X4Y1 | OFF | OFF | OFF | OFF | ON | OFF |
| X2Y2 | OFF | OFF | OFF | OFF | OFF | OFF |
| X3Y2 | OFF | OFF | OFF | OFF | OFF | OFF |
| X4Y2 | OFF | ON | ON | OFF | OFF | OFF |
| X3Y3 | OFF | OFF | OFF | OFF | OFF | OFF |
| X4Y3 | ON | ON | OFF | ON | ON | OFF |
| X4Y4 | OFF | ON | OFF | ON | ON | ON |

Figure 7:
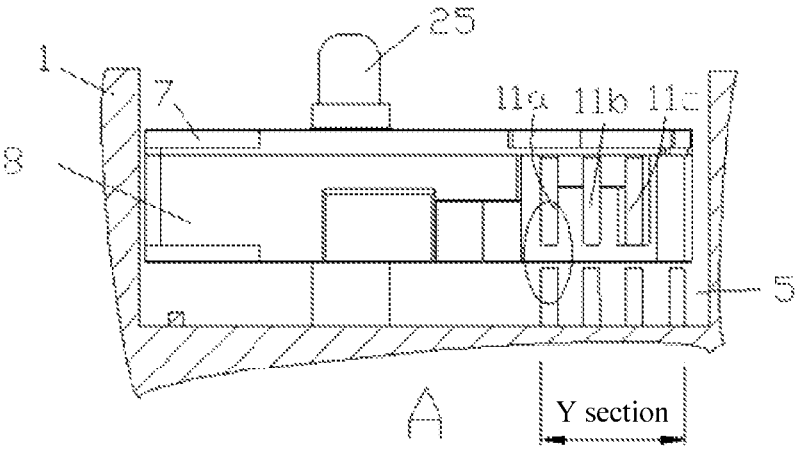
FIG. 7 is a schematic view of the ribbon cassette A that is installed into the printing device but not yet contacted with the determining column according to the present invention.
Figure 8:
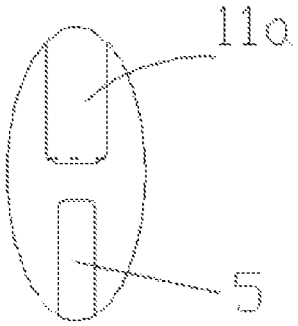
FIG. 8 is a schematic view illustrating relationship between detecting column diameter and determining column diameter according to the present invention.

When the printing tape (label) 18 has a width of 9 mm, the determining columns X4Y2, X4Y3, and X4Y4 are in ON state, that is, X4Y2, X4Y3, and X4Y4 are compressed, while the other columns are in OFF state, that is, the other determining columns are not compressed. FIG. 7 shows the ribbon cassette that has been installed into the printer device but not yet contacted with the determining column XY. It can be seen from FIG. 8 that the diameter of the detecting column 11*a* of the ribbon cassette is greater than that of the determining column XY of the printing device, which prevents the case that the detecting column 11 cannot compress down the determining column XY due to a slight misplacement. One width of the printing tape only corresponds to one type of structure, which reduces the number of molds used, and also effectively reduces cost of the product. Meanwhile the reinforcing rib 40 designed improves the damage resistance of the detecting column so that it is not easy to be damaged and broken.

Figure 9:
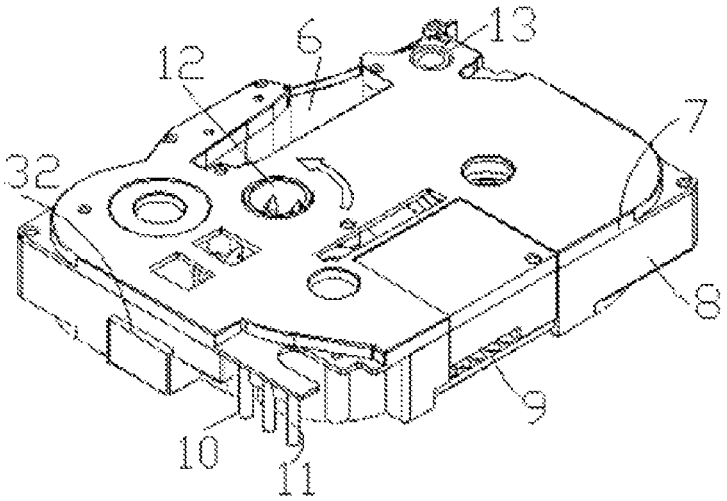
FIG. 9 is a perspective view of a ribbon cassette with a 9 mm-wide printing tape according to the present invention.
Figure 10:
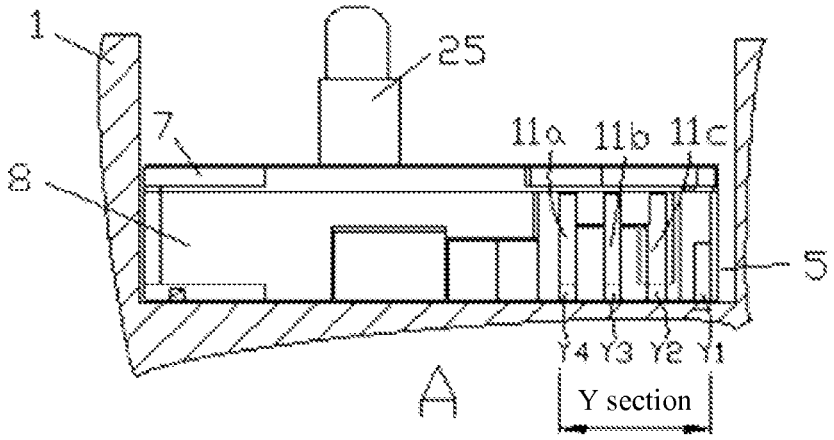
FIG. 10 is a schematic view of a ribbon cassette cooperating with a printing device according to the present invention.
Figure 21:
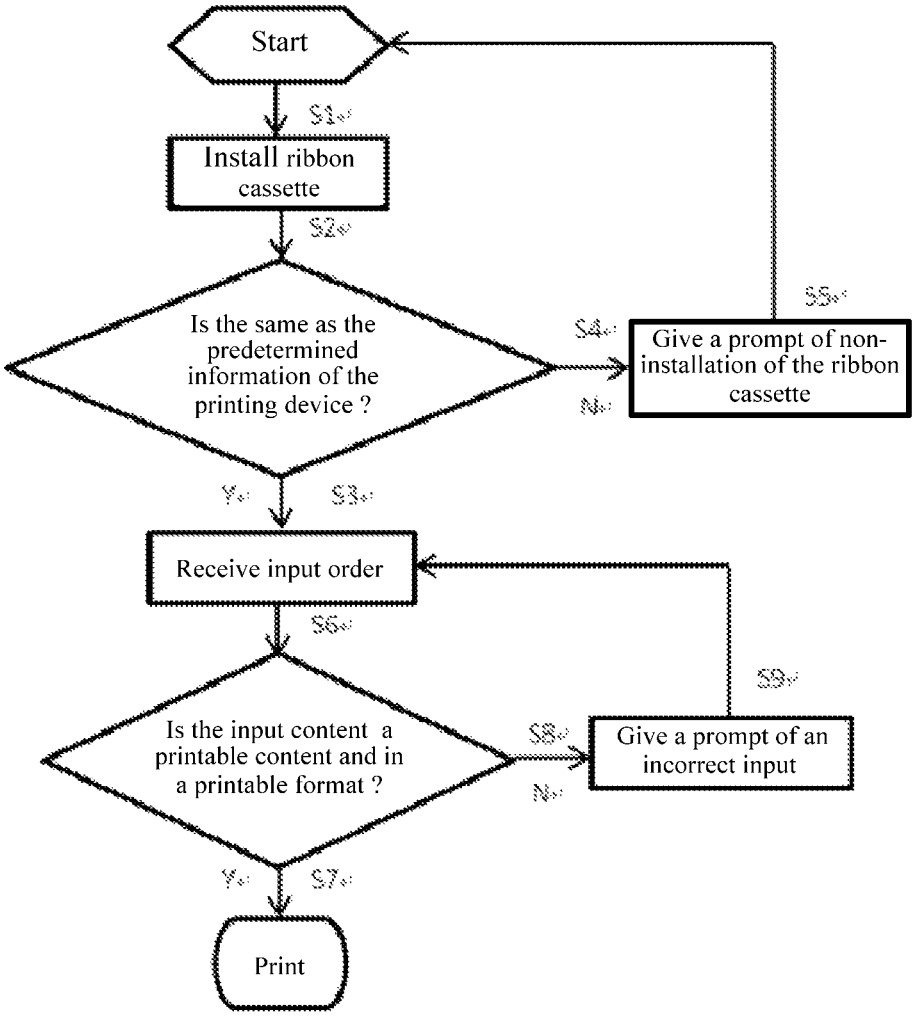
FIG. 21 is a flow chart illustrating a process after a ribbon cassette is installed into a printing device.

The determination process of a 9 mm-wide printing tape will be described in detail with reference to FIGS. 9-10 and FIG. 21. After being switched on power, the printing device 1 is in S1 state: a starting state; and the user is in S2 state: after the ribbon cassette is installed, the detecting column 11 disposed at the detecting portion 10 of the ribbon cassette interacts with the determining column XY positioned at the detecting region 5 of the printing device and sends out information; S3: the printing device determines whether the information (i.e., the information of the printing tape width) is the same as the predetermined information of the printing device, for example, FIG. 10 is a schematic view of a 9 mm-wide printing tape coordinating with the determining column XY of the printing device, the determining columns X4Y2, X4Y3 and X4Y4 are compressed down by the detecting columns 11*c*, 11*b* and 11*a* respectively, to become ON state, and if the information of the printing tape width is the same as the predetermined information of the printing device, then S3: the displaying region 4 of the printing device gives a prompt of receiving input order of the user; if the information is different from the predetermined information of the printing device, then S4: the displaying region 4 of the printing device gives a prompt of non-installation of the ribbon cassette, and then the user should press "ENTER" or "RESET" button to return to S1: the starting state. When the user gets S3: receiving the input order, he can input a printing content, and then press "PRINT" bottom, then the printing device executes S7: determining whether the input content is a printable content and in a printable format. If yes, then execute the printing task; and if no, then S8: the displaying region 4 gives a prompt of an incorrect input content, and suggests the user to input them again and after that, the user can press "ENTER" bottom to return to S6, and at the moment, the printing device is in a state of waiting for input.

Figure 11:
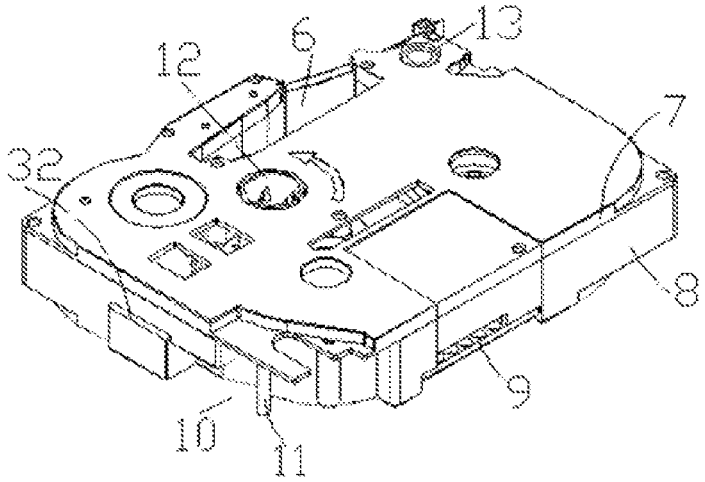
FIG. 11 is a perspective view of a ribbon cassette with a 6 mm-wide printing tape according to the present invention.
Figure 12:
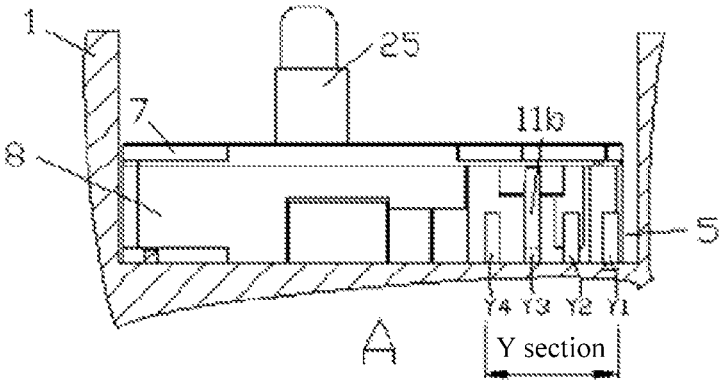
FIG. 12 is a schematic view of a ribbon cassette cooperating with a printing device according to the present invention.

FIGS. 11-12 show a view of a 6 mm-wide printing tape coordination with the determining column XY of the printing device. The difference between the 6 mm-wide printing tape and the 9 mm-wide printing tapes (referred to as 9 mm width tape for short hereinafter) are that the 9 mm width tape has three detecting columns 11*a*, 11*b* and 11*c*, that is, it needs to compress down the determining columns X4Y2, X4Y3 and X4X4 in order to make them be in ON state, whereas the 6 mm width tape has internal predetermined information that defines X4Y3 to be in ON state, while the rest are in OFF state, and the corresponding ribbon cassette contains only the detecting column 11*b*.

Figure 13:
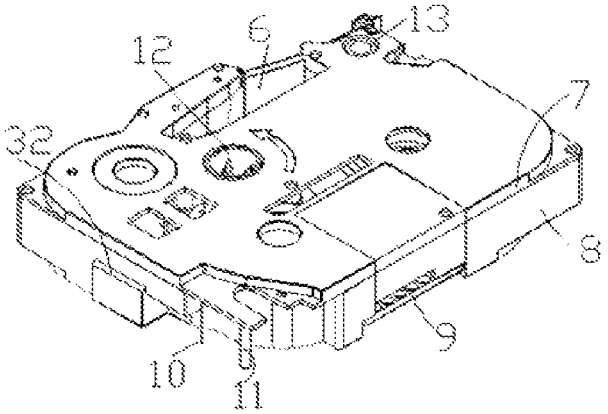
FIG. 13 is a perspective view of a ribbon cassette with a 12 mm-wide printing tape according to the present invention.
Figure 14:
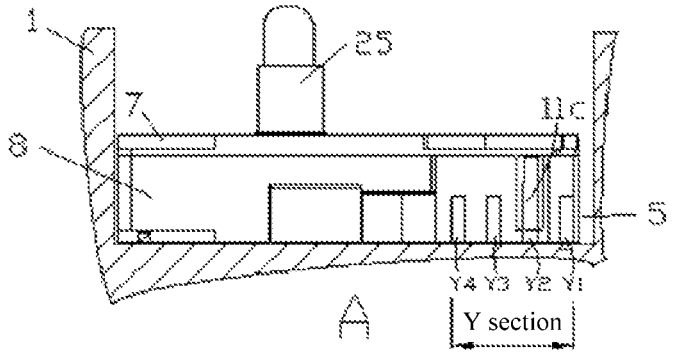
FIG. 14 is a schematic view of a ribbon cassette cooperating with a printing device according to the present invention.

FIGS. 13-14 show a view of a 12 mm width tape coordination with the determining column XY, where it needs to compress down the determining column X4Y2 to make it be in ON state, and the rest are in OFF state, and the corresponding ribbon cassette contains only the detecting column 11*c*.

Figure 15:
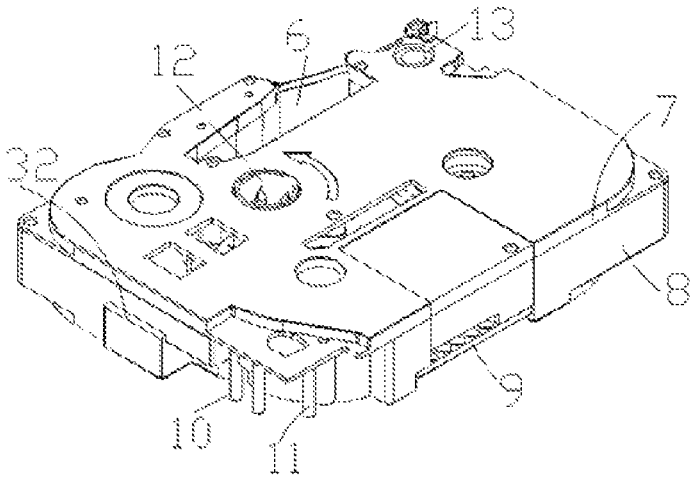
FIG. 15 is a perspective view of a ribbon cassette with a 18 mm-wide printing tape according to the present invention.
Figure 16:
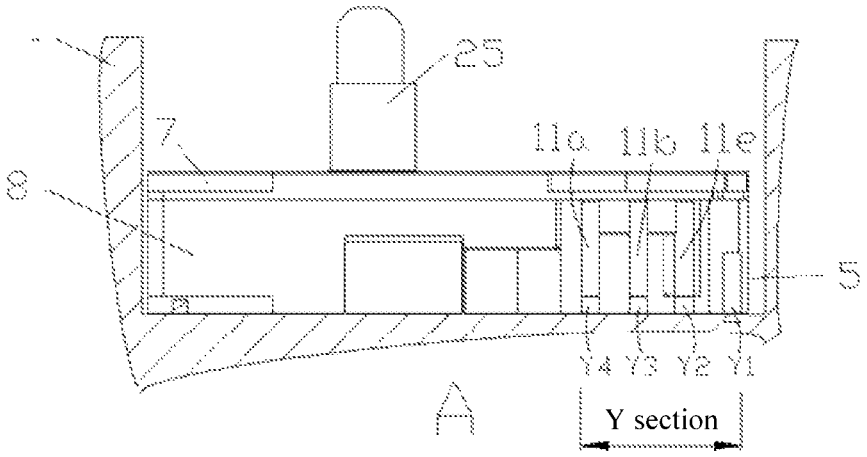
FIG. 16 is a perspective view of a ribbon cassette cooperating with a printing device according to the present invention.

FIGS. 15-16 show a view of a 18 mm width tape coordinating with the determining column XY. It requires compressing down the determining columns X4Y3, X4Y4 and X3Y2 to make them be in ON state, and the rest are in OFF state, and the corresponding ribbon cassette contains the detecting columns 11*a*, 11*b* and 11*e*.

Figure 17:
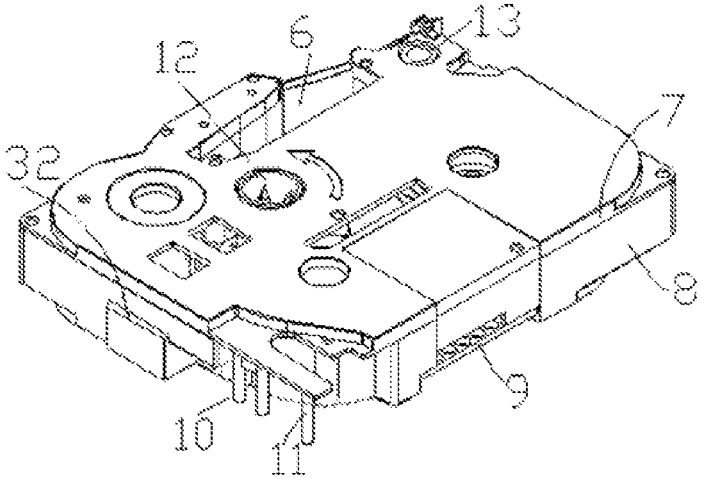
FIG. 17 is a perspective view of a ribbon cassette with a 24 mm-wide printing tape according to the present invention.
Figure 18:
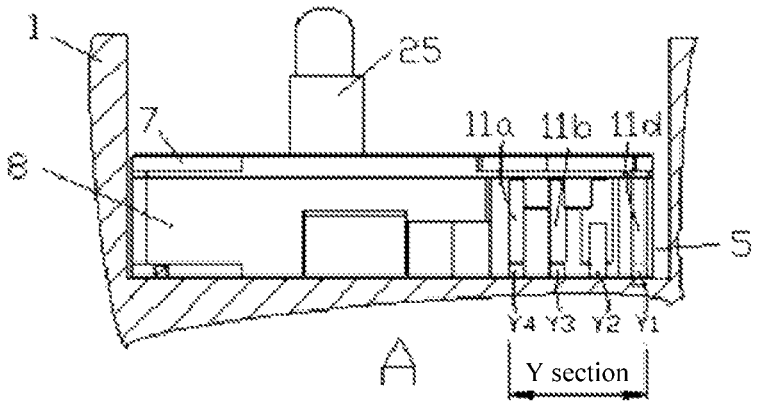
FIG. 18 is a perspective view of a ribbon cassette cooperating with a printing device according to the present invention.

FIGS. 17-18 show a view of a 24 mm width tape coordinating with the determining column XY. It requires compressing down the determining columns X4Y1, X4Y3 and X4Y4 to make them be in ON state, and the rest are in OFF state, and the corresponding ribbon cassette contains the detecting columns 11*a*, 11*b* and 11*d*.

Figure 19:
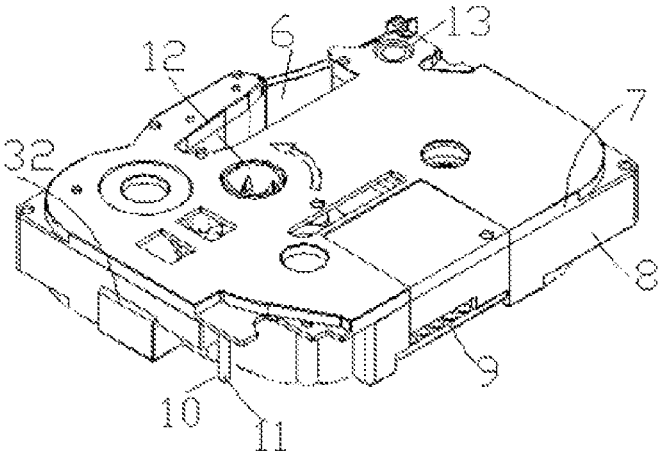
FIG. 19 is a perspective view of a ribbon cassette with a 36 mm-wide printing tape according to the present invention.
Figure 20:
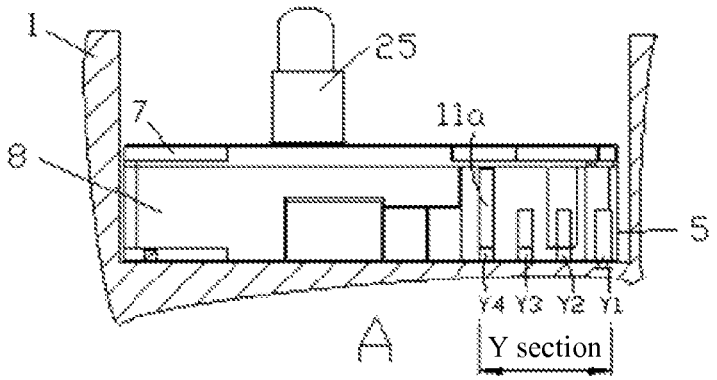
FIG. 20 is a schematic view of a ribbon cassette cooperating with a printing device according to the present invention.

FIGS. 19-20 show a view of a 36 mm width tape coordinating with the determining column XY. It requires compressing down the determining column X4Y4 to make them be in ON state, and the rest are on OFF state, and the corresponding ribbon cassette contains the detecting column 11*a*.

Figure 28:
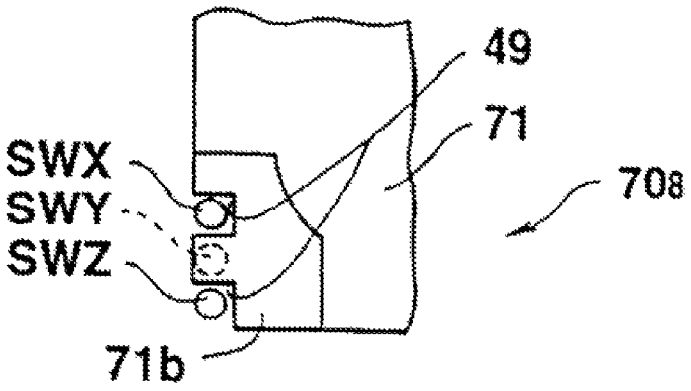
FIG. 28 (PRIOR ART)
FIG. 28 is a diagram of the prior art.
Figure 29:
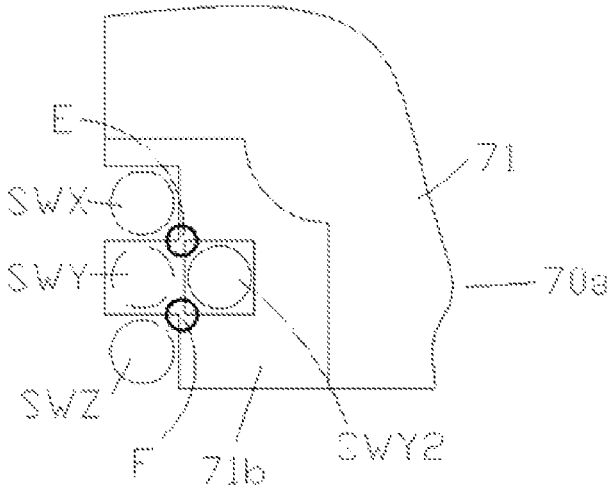
FIG. 29 (PRIOR ART)
FIG. 29 is a schematic view of a hypothetical solution of the prior art with reference to FIG. 15.

FIG. 28 shows a diagram of prior art, where the information of the ribbon cassette is determined through whether a gap exists, i.e., determined through whether switches SWX, SWY and SWZ are pressed, but when the determining column is at the position as shown in FIG. 29 (designated as SWY2 in the figure), the printing tape corresponding to the ribbon cassette actually has a width of 18 mm, the same width as in FIG. 15, and thus the distance at positions E and F is very small, specifically the width is only around 0.5-0.8 mm, which is difficult to be accomplished in actual production.

Embodiment 2

Figure 22:
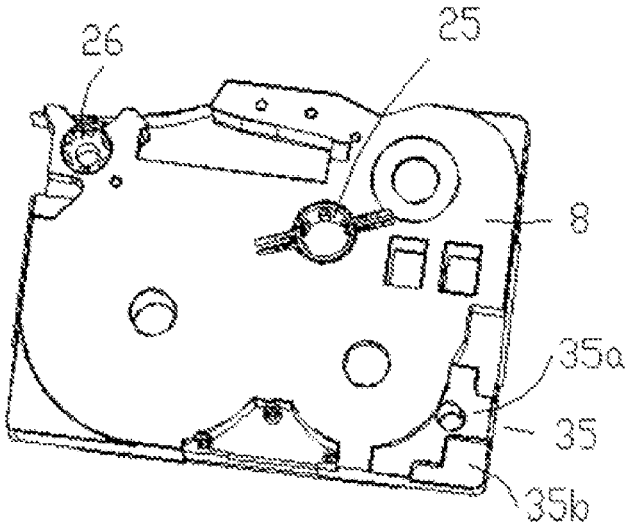
FIG. 22 is a perspective view of a ribbon cassette with a detecting surface and a 12 mm width tape detecting side according to a specific embodiment of the present invention.
Figure 23:
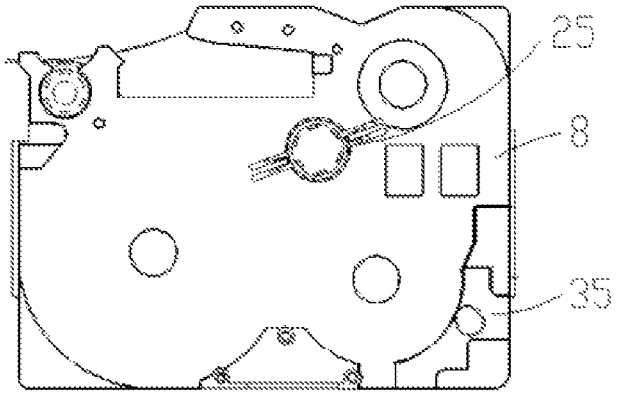
FIG. 23 is a plan view of a ribbon cassette with a detecting surface and a 12 mm width tape according to a specific embodiment of the present invention.

Like the ribbon cassette of Embodiment 1, the ribbon cassette according to the embodiment, as shown in FIG. 22, is composed of an upper cover 7 and a lower cover 8, and a ribbon cassette case formed therebetween. The ribbon cassette case accommodates a printing tape 18 for printing, a medium tape 17 for providing printing medium and a carrier tape 20 used as a carrier. Different from the Embodiment 1, the detecting column XY of the Embodiment 2 is designed as a detecting surface 35. The detecting surface 35 includes convex and concave surfaces with different heights, where the number, position, or a combination of the number and position of the determining column crimped by the convex surface characterizes the features of the ribbon cassette, the crimped two or more determining columns correspond to a convex surface, whereas the non-crimped two or more determining columns correspond to a concave surface. The detecting surface 35 is formed independently by an upper or lower surface, and its cooperation relationship with the printing device 1 will be described in detail with reference to the figures.

Figure 24:
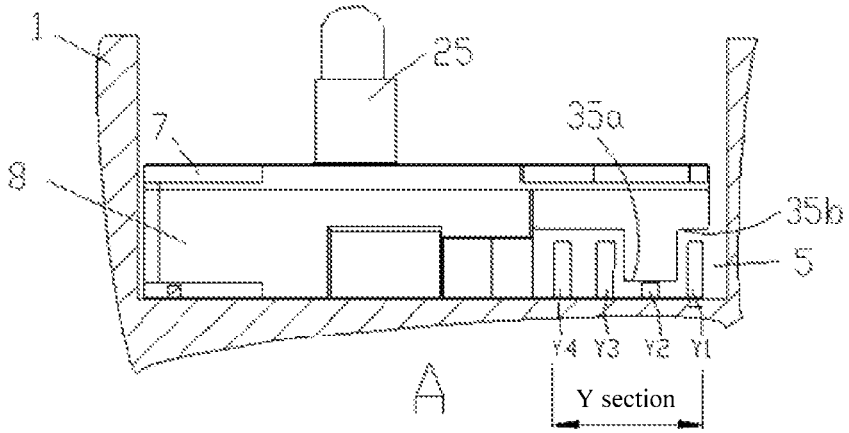
FIG. 24 is a perspective view of a ribbon cassette having a detecting surface and a 12 mm width tape cooperating with the determining column according to the present invention.

FIG. 22 is perspective view of 12 mm wide tape, and the detecting surface 35 is designed at the second corner 101 that is diagonally opposite to the first corner 100. More specifically, the detecting surface 35 is in a ladder shape, i.e., the detecting surface 35 has a convex surface 35*a* and a concave surface 35*b* which have different heights. FIG. 24 shows a view of coordinating the detecting surface 35 with the determining column XY of the printing device 1, and the printing device's predetermined information is that: when the X4Y2 is in ON state but the rest are in OFF state, this represents a 12 mm wide tape. As shown in FIG. 24, the convex surface 35*a* compresses the moveable determining column X4Y2 into inside of the printing device, and the concave surface 35*b* is sunk towards inside of the ribbon cassette, to avoid the remaining determining columns XY, and achieve the purpose that the X4Y2 is in ON state while the rest are in OFF state. The aforementioned function is achieved using the detecting surface 35. The detecting surface 35 has simple structure, easily formed mold, and high efficient and feasible determination, and thus is a creative design.

Figure 25:
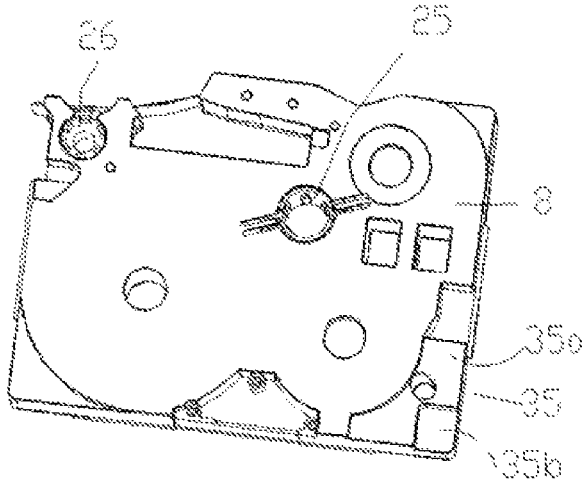
FIG. 25 is a perspective view of a ribbon cassette with a detecting surface and a 9 mm width tape according to a specific embodiment of the present invention.
Figure 26:
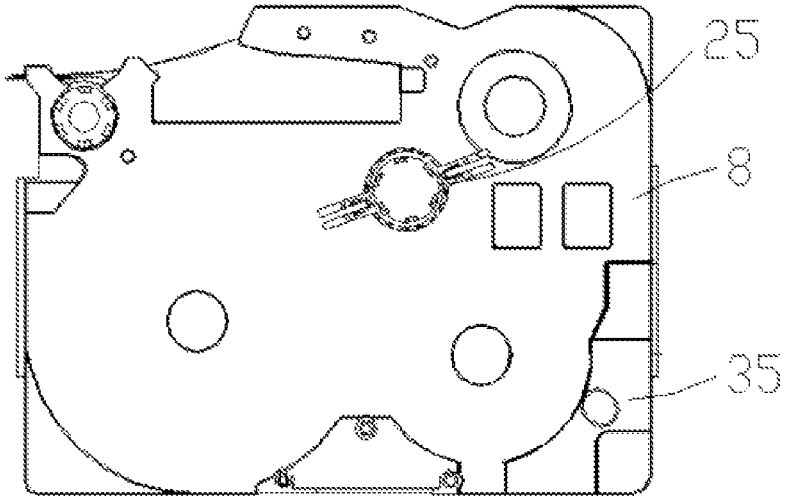
FIG. 26 is a plan view of a ribbon cassette having a detecting surface and a 9 mm width tape according to a specific embodiment of the present invention.
Figure 27:
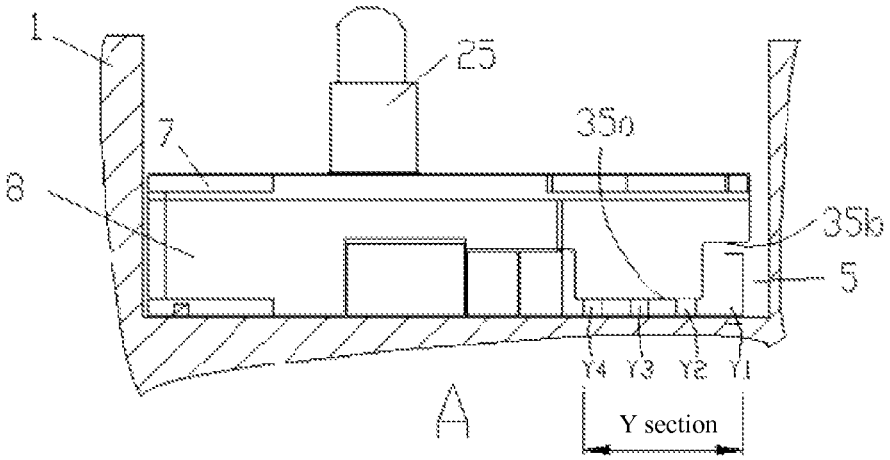
FIG. 27 is a schematic view of a ribbon cassette having a detecting surface and a 9 mm width tape cooperating with the determining column according to the present invention.

FIG. 25 shows a perspective view of 9 mm width tape, which also designed with the detecting surface 35. FIG. 27 shows a view of the detecting surface 35 cooperating with the determining column XY of the printing device 1, and the predetermined information of printing device is that: when the X4Y2, X4Y3 and X4Y4 is in ON state but the rest are in OFF state, this represents a 9 mm width tape. The convex surface 35*a* compresses the movable determining columns X4Y2, X4Y3 and X4Y4 into inside of the printing device, and the concave surface 35*b* is sunk towards inside of the ribbon cassette, to avoid the remaining determining column XY, and achieve the purpose of the X4Y2, X4Y3 and X4Y4 in ON state but the rest in OFF state.

The above provides specific embodiments of a 12 mm and a 9 mm width tapes, and likewise, the printing tapes with different widths such as 6 mm, 24 mm and 36 mm can adopt the same technical means, and will not be repeated here.

Specific modes described in the Embodiment 1 and the Embodiment 2 and their simple variations, and other variations obtained by those skilled in the art without any creative work, are all within the protection scope of the present invention.

What is claimed is:

1. A ribbon cassette for a label printing device, wherein the label printing device is provided with a determining region for determining feature information of the ribbon cassette, the determining region is provided with a plurality of determining columns, the ribbon cassette comprises a ribbon cassette case, the ribbon cassette case accommodates a printing tape for printing, a medium tape for providing printing medium and a carrier tape used as a carrier, and the ribbon cassette further comprises a detecting portion corresponding to the determining region of the label printing device, wherein the detecting portion is one or more detecting columns corresponding to the determining columns, and the number of the detecting column characterizes the feature of the ribbon cassette, the position of the detecting column characterizes the feature of the ribbon cassette, or a combination of the number and the position of the detecting column characterizes the feature of the ribbon cassette, and wherein there are a plurality of the detecting columns, and a reinforcing rib is provided between adjacent detection columns.

2. The ribbon cassette of claim 1, wherein the detecting column is in a cylindrical shape.

3. The ribbon cassette of claim 1, wherein the detecting column is in a columnar shape with an oval cross-section.

4. The ribbon cassette of claim 1, wherein the detecting column is in columnar shape with a square or rectangular cross-section.

5. The ribbon cassette of claim 2, wherein the column surface of the detecting column can completely cover the corresponding column surface of determining column.

6. The ribbon cassette of claim 3, wherein the column surface of the detecting column can completely cover the corresponding column surface of determining column.

7. The ribbon cassette of claim 4, wherein the column surface of the detecting column can completely cover the corresponding column surface of determining column.

8. The ribbon cassette of claim 1, wherein the feature of the ribbon cassette comprises width of the printing tape in the ribbon cassette, width and color of the medium tape, width and color of the carrier tape, width of the ribbon cassette and printing mode of the printing tape.

9. The ribbon cassette of claim 2, wherein the feature of the ribbon cassette comprises width of the printing tape in the ribbon cassette, width and color of the medium tape, width and color of the carrier tape, width of the ribbon cassette and printing mode of the printing tape.

10. The ribbon cassette of claim 3, wherein the feature of the ribbon cassette comprises width of the printing tape in the ribbon cassette, width and color of the medium tape, width and color of the carrier tape, width of the ribbon cassette and printing mode of the printing tape.

* * * * *